United States Patent [19]

Wittenberg

[11] 4,099,983

[45] Jul. 11, 1978

[54] PROCESS FOR PREPARING HIGH PURITY LACTOSE

[76] Inventor: Lester H. Wittenberg, 103 Devoe Rd., Chappaqua, N.Y. 10514

[21] Appl. No.: 801,874

[22] Filed: May 31, 1977

[51] Int. Cl.[2] ..... C13K 5/00

[52] U.S. Cl. ..... 127/63; 127/31; 127/64

[58] Field of Search ..... 127/31, 63, 64

[56] References Cited

U.S. PATENT DOCUMENTS

| | | | |
|---|---|---|---|
| 1,500,770 | 7/1924 | Ryan | 127/31 |
| 2,439,612 | 4/1948 | Peebles | 127/31 |
| 2,555,211 | 5/1951 | Wallace | 127/31 |
| 2,584,158 | 2/1952 | Pratt | 127/31 |
| 3,785,865 | 1/1974 | Pollard | 127/31 X |

OTHER PUBLICATIONS

Chemical Abstracts, 55:15967i (1961).

S. M. Weisberg, Jour. Dairy Sci., 37, 1106–1115 (1954).

*Primary Examiner*—Sidney Marantz

[57] ABSTRACT

Lactose crystals of improved purity and reduced color are obtained by washing the lactose crystals in an alkaline wash-bath having a pH within the range of from about 8.5 to about 12.5. The isolated washed crystals exhibit improved purity particularly in the reduction of nitrogen-containing impurities as evidenced by a reduced total Kjeldahl nitrogen content and a substantially white color.

10 Claims, No Drawings

PROCESS FOR PREPARING HIGH PURITY LACTOSE

BACKGROUND OF THE PRESENT INVENTION

The present invention relates to a new process for purifying and decolorizing lactose crystals.

Lactose or milk sugar is a standard item of commerce which is generally prepared by crystallizing the same from cheese whey. The basic procedures utilized in crystallizing lactose from whey are outlined in Chapter 12 of *Byproducts From Milk,* edited by B. H. Webb (1970). Lactose is produced in four general grades of increasing purity, i.e., fermentation, crude, edible and USP. Fermentation grade lactose contains 98% lactose, crude grade lactose, 98.4% lactose, edible grade lactose 99% lactose and USP grade lactose 99.85% lactose. The protein content decreases from 1.0% to 0.01%. The ash and lipid content also decrease. Color decreases from a yellowish color to a white color from the fermentation grade through the USP grade.

The isolation of lactose from whey is generally accomplished by the simple process of concentration and crystallization. The crystals are separated while most of the whey protein and salts are carried off in the mother liquor. However, some of the protein and salts present during crystallization will contaminate the sugar, particularly if they become insoluble during the concentration of the whey. Methods for preparing various grades of lactose generally include methods for keeping the whey protein and ash component solubilized or removing these components prior to crystallization. Even the most effective process for crystallizing lactose will provide a product which has some ash and color.

In the past, preparation of USP grade lactose has required decolorization which has been accomplished by redissolving the crude lactose and treating the same with carbon while boiling. After filtering the carbon, the lactose is again recrystallized. The use of this process in the preparation of edible grade lactose is economically unfeasible though it would be desirable to decolorize the edible grade lactose which tends to have a slight yellowish hue.

It is known that certain amounts of color and impurities can be removed from the lactose by aqueous washing. However, lactose is partially soluble in water and repeated washings cause loss of lactose by solubilization. If the washings are not recycled to the crystallizer, the lactose is lost in sewering the washings.

It is suspected that the yellow color is attributable to the riboflavin contained in the original whey. Riboflavin is known to be soluble with decomposition in dilute alkali (see the definition of riboflavin in the Merck Index, 8th Edition (1968), pages 918–919). The decomposition products are also known to be colored.

It is also known from U.S. Pat. No. 3,816,174 that the treatment of lactose with sodium hydroxide at a high temperature for a short time, or a low temperature for a long time will isomerize the lactose into lactulose syrup. Decolorization of the product is still required which decolorization is accomplished by ion exchange resins.

It has now been found that lactose can be easily and economically decolorized without sustaining substantial loss of the lactose product.

BRIEF OUTLINE OF THE PRESENT INVENTION

In accordance with the present invention, it has been found that lactose can be purified by washing lactose crystals in an alkaline wash bath having a pH within the range of from about 8.5 to about 12.5 followed by isolating the so-washed lactose crystals. The washed crystals exhibit improved whiteness and purity over and above the unwashed crystals or crystals washed in water under the same conditions of time, temperature and frequency without a substantial loss of lactose in the washing procedure.

In theory, it is suspected that color and other impurities are entrained on the surface of the lactose crystals. The use of the alkaline wash assists in freeing the entrained impurities so that they can be easily washed off the surface of the crystals. Further, decolorization resulting from the decomposition of the riboflavin is avoided by conducting the washing reaction sufficiently rapid manner to avoid substantial riboflavin decomposition. The dissolved impurities including the riboflavin can be separated from the crystals without substantial recontamination of the crystal surface and disposed of.

The lactose crystals which are used in the present invention can be derived by any known procedure for separating lactose from its parent material. In general, lactose can be separated by concentration and crystallization from whey. The whey source utilized is not critical and can include both acid and sweet wheys from cottage cheese, cheddar cheese, Mozzarella cheese, Swiss cheese and the like. The lactose can be used directly from the crystallizers or dried lactose can be reslurried and effectively treated to reduce the color.

In order to be treated in accordance with the present invention, the lactose crystals must be washed in an aqueous alkaline bath. This can be easily accomplished by dropping a wet cake of lactose crystals from a separator following crystallization into a reslurrying tank. The pH of the water in the tank can be above 8.5 prior to the addition of the lactose crystals or the pH can be adjusted after the crystals are reslurried. In a similar manner, dried lactose can be reslurried under similar conditions to accomplish the washing.

In order to reduce the solubilization of lactose crystals during the washing procedures, it is preferred to utilize cold water (above about 35° F. or 1.7° C.) in conducting the alkaline and water washes. Water of higher temperature can be utilized though this is less preferred. Shorter wash times may be required in using water of higher temperature to reduce the amount of lactose solubilized.

The alkaline material used to raise the pH of the aqueous wash bath can be any material which will form an alkaline aqueous solution. These materials are illustrated by the oxides, hydroxides and carbonates of alkali and alkaline earth metals. If the product is generally intended for food use, food grade chemicals are preferred. The preferred class of food grade chemicals generally includes oxides, hydroxides and carbonates of sodium, potassium and calcium. It has also been found that ammonium hydroxide and lithium hydroxide can be effectively used to reduce the color. The most preferred material is sodium hydroxide because of its low cost and ease of use.

The alkaline material can be added in dry form or liquid form either before the lactose crystals have been reslurried or after as desired. It is preferred to utilize a liquid solution of the alkaline material for ease of metering. Specifically, an aqueous solution of sodium hydroxide can be effectively metered into the reslurrying tank in small quantities as desired to adjust the pH. Since hydrating of sodium hydroxide pellets involves heat, it is preferred not to utilize solid sodium hydroxide when adding the same to an aqueous solution containing the lactose crystals as this may increase the solubilization of the lactose.

An acceptable pH range of the alkaline wash bath is within the range of from about 8.5 to 12.5. Preferably, the pH range is from about 9 to 12 and more preferably from about 9.5 to 11.5. The use of a pH above 12.5 is not recommended since the high pH's dissolve more lactose and products prepared from elevated pH's have more entrained residual alkali. More lactose would be dissolved and possibly lost in attempting to remove entrained alkaline material.

The crystal concentration in the wash bath is not critical. A crystal concentration of from about 5 to 60% can be used. It is preferred that the concentration be sufficiently high to prevent solubilization of the lactose. It has been found that a concentration of about 30–40% lactose in the alkaline wash tank is effective. Wash waters not containing alkali are generally utilized in a ratio of 1 part lactose to 1 part water. These are suggested ranges as there is no basic lower limit for the concentration of lactose. The dissolution rate of the lactose provides a practical lower limit of concentration since large scale dissolution of the lactose is preferably avoided.

The process of the present invention does not require long times nor elevated temperatures to accomplish its result. No critical amount of time is known to be needed to effect the decolorization and/or purification of lactose crystals. Sufficient time to effect the purification and decolorization can be achieved during the mixing procedure. Further holding only tends to increase the amount of lactose solubilized. Since it is known from U.S. Pat. No. 3,816,174 that lactulose can form by treating lactose in a highly alkaline system for a long period of time at room temperature, the use of excessive holding of the lactose crystals in the caustic wash bath is to be avoided.

The temperature at which lactose crystals are washed in the caustic wash bath should be relatively cold to prevent undesirable dissolution of lactose. Temperatures within the range of about 35°–80° F. (1.7°–20.7° C) and preferably about 38°–60° F. (3.3°–15.6° C.) are preferred. Excessive elevated temperatures are to be avoided as temperature contributes to the lactulose reaction mentioned in the preceding paragraph.

There is no particular requirement for the equipment needed to reslurry the lactose crystals. It has been found effective to utilize a tank provided with an alkali injector and agitation means. Any equipment designed to accomplish the end of reslurrying the crystals in an aqueous alkaline system with sufficient agitation to effectively and uniformly wash the crystals can be utilized. Continuous systems such as a conduit or other means adapted for continually washing lactose crystals preferably with agitation can also be used.

After the washing, the crystals are isolated from the wash solution by any appropriate means for separating a particulate material in a slurry from the aqueous liquid. A preferred means of separating the lactose crystals is by the use of a basket centrifuge. After the liquid is separated by means of the centrifuge, the filter cake can be washed by spraying with cold water. A second caustic wash can be used if desired. The latter is less preferred because of the cost involved and the amount of lactose which is redissolved and lost.

After washing, the product is dried. The product can be dried directly from the basket centrifuge after the internal water wash or after reslurrying and reseparating as desired. The type of dryer utilized is that type of equipment normally used in drying lactose. Lactose crystals are effectively dried in a fluid bed dryer. If desired, the washed lactose crystals can also be redissolved and spray dried.

The process of the present invention must be conducted under such conditions that allow the lactose to be in substantial contact with the alkaline solution for a period of time sufficient to provide the washing effect. It has been found that spraying the aqueous alkaline solution onto a bed of lactose crystals in a centrifuge will not provide the decolorization effect noted in using the tank type washing system. The short time contact of small volumes of alkaline bath with the lactose is ineffective because the pH of the bath radically changes within a very short period of time to negate the alkaline effect. Washing the lactose crystals in a large enough volume of spray water for a long enough period of time to approximate a bath wash may overcome this problem.

The process of the present invention effects a significant reduction in the total Kjeldahl nitrogen content as well as reducing the color of the lactose. The degree of reduction of the total Kjeldahl nitrogen and decolorization is directly related to the purity of the original feed lactose. In some instances, extremely low grade lactose can be improved another grade by means of the process of the present invention. If sufficiently pure lactose is utilized, particularly from the permeate obtained from the ultrafiltration of whey, USP grade lactose can be obtained if the caustic wash material is filtered to remove the insoluble materials. Under normal circumstances, the color of a lactose sample can be significantly reduced. In some instances, colorless (white) material can also be obtained. Typically, commercial lactoses other than carbon treated or USP grades will have analyses similar to the following:

Lactose-mono hydrate: 99.0–99.5%
Free-water: 0.1–0.5%
Protein - N X 6.35: 0.1–0.3%
Ash: 0.1–0.3%
Color - Neotec B scale: greater than 6%

The present invention provides a product having a general analysis equal to or better than the above. The purified and decolorized lactose of the present invention can be produced at a lower cost in comparison to prior art materials prepared by other prior art processes.

The lactose of the present invention can be used in any area normally utilizing lactose. Lactose can be used in infant foods, special dietary products, pharmaceuticals and other similar applications. Use in any one area may be guided by the particular chemical composition of the products of the present invention relative to protein and ash.

The invention is further illustrated in the examples which follow.

EXAMPLES 1–4

TANK CAUSTIC WASH 1800 lbs. (816.48 kilograms) of lactose crystals prepared by crystallizing the lactose from the permeate remaining after the separation of whey protein from whey by ultrafiltration and recovered by spinning out the liquor in a basket centrifuge were placed in a wash tank along with 120 gallons (454.80 liters) of fresh water. 2500 grams of a 50% caustic solution were then added to the wash tank. The pH in the wash was raised from pH 6.8 to 10.3. After a wash period of 5 minutes, the mother liquor was separated from the lactose crystals in a basket centrifuge. The crystals were washed by spraying cold water over the bed of crystals in the centrifuge. After spinning off the liquid, the crystals were dried in a fluid bed dryer. Subsequent batches (Examples 3 and 4) were added to the caustic bath recovered from the preceding run. No new caustic was added. As new lactose was added, the pH decreased as shown in Table I below. All samples were tested for yellowness using a Hunter Color and Color Difference Meter and the following results were obtained:

TABLE I

| Ex. | Condition | pH in Wash Tank | Differential Color Yellowness* | Redness* | Lightness* |
|---|---|---|---|---|---|
| 1 | Wet Cake | control 6.8 | 13.3 | −6.2 | 95.9 |
| | Dry | control 6.8 | 9.3 | −4.2 | 97.1 |
| 2 | Wet | 10.3 | 6.3 | −4.2 | 97.0 |
| | Dry | 10.3 | 4.3 | −2.2 | 97.2 |
| 3 | Wet | 10.0 | 13.6 | −6.9 | 96.2 |
| | Dry | 10.0 | 7.5 | −3.5 | 97.1 |
| 4 | Wet | 9.6 | 11.0 | −6.0 | 96.9 |
| | Dry | 9.6 | 7.5 | −3.8 | 97.4 |

*Lower numbers mean less yellow color

**A lightness of zero is black to a lightness of 100 which is white.

The product of Example 2 was analyzed with the following results:

Ash: 0.03%

Total Kjeldahl Nitrogen: 0.06%

Moisture: 0.31%

As can be seen from the results of Examples 1–4, the use of a caustic bath wash significantly reduces the yellowness of the lactose without effecting redness or lightness. Ash content of the product is within acceptable commercial limits.

EXAMPLES 5–9

SPRAY CAUSTIC WASH

A slurry of lactose crystals from the crystallizer was put into a basket centrifuge. After the mother liquor was spun off, the bed of lactose crystals was sprayed with 64 gallons (242.6 liters) of a caustic wash water prepared by combining 1 ½ gallons (5.69 liters) of 50% caustic in 450 gallons (1705.5 liters) of fresh cold water (about 40° F. or 4.4° C.). Wash water spraying time was approximately 36 seconds. After the caustic wash, the samples are plowed out of the basket, reslurried and recentrifuged. Colorimetric measurements using a Hunter Color and Color Difference Meter were taken. The following results were obtained:

TABLE II

| Example Ex. 5 | Wash Water pH | | Color Difference Measurement I After Caustic Wash Wet | Dry | II After Water Washing of Reslurried Caustic Washed Crystals Wet | Dry |
|---|---|---|---|---|---|---|
| (control) | 6.8 | Y | 22.9 | 16.2 | 19.3 | 13.7 |
| Waterwash | No Caustic | R | −8.9 | −6.1 | −8.3 | −5.8 |
| | | L | 95.2 | 96.1 | 96.0 | 97 |
| Ex. 6 | 6.8–12.4 | Y | 23.7 | 17.5 | 21.1 | 12.8 |
| | | R | −9.1 | −6.8 | −8.6 | −5.3 |
| | | L | 95.0 | 96.7 | 95.0 | 97.1 |
| Ex. 7 | 12.4 | Y | 21.1 | 16.3 | 17.8 | 12.3 |
| | | R | −8.7 | −6.8 | −8.2 | −5.7 |
| | | L | 95.2 | 97.1 | 97.1 | 97.5 |
| Ex. 8 | 12.4 | Y | 21.0 | 12.5 | 17.2 | 12.5 |
| | | R | −8.6 | −5.3 | −8.1 | −5.6 |
| | | L | 95.5 | 96.9 | 96.4 | 97.5 |
| Ex. 9 | 12.4 | Y | 22.8 | 16.2 | 14.1 | 10.4 |
| | | R | −9.2 | −6.5 | −6.9 | −5.1 |
| | | L | 95.2 | 96.8 | 97.0 | 97.7 |

Y = Yellowness
R = Redness
L = Lightness

As can be seen from the preceding data, the use of a spray caustic wash does not significantly reduce the yellowness. On the average, the yellowness (Y) of a dry product is never reduced below 12. Yellowness (Y) at least below 10 for a dry product is required for a commercial high quality product.

EXAMPLE 10

A series of 37 consecutive plant cycles were run using the procedure as outlined in Examples 1–4. The total solids charged was 32,722 lb.s (14842.7 kilograms). Expected yield based on a recovery factor of 38% derived by considering loss in each stage of the reaction as per the following: (80% crystallization) (80% impurity) (87% 1st wash) (85% reslurry) (88% 2nd wash) (90% minimum heel wash) is 12,435 (5640.5 kilograms). Total yield obtained was 10,550 lbs. (4785.5 kilograms) or 84.8% yield.

Each cycle processed 156 gallons (591.24 liters) of lactose slurry. Each cycle required approximately 15 minutes from the time the lactose crystals are dropped from the basket centrifuge into the caustic wash tank until another batch of crystals was dropped into the tank. The pH in the caustic wash tank varied from 7.25 for the first cycle prior to caustic addition to a high of 11.4. A large proportion of the pH's observed ran from 10.1 to 10.8 with a pH between 10.4 to 10.6 being most prevalent.

A sample of the blended products of the cycles was analyzed with the following results. Units are in percent unless otherwise noted.

TABLE III

| | Product-Ex. 10 | Specification for Commercial Products |
|---|---|---|
| Total Kjeldahl nitrogen | 0.07 | 0.2 |
| Color | 9.3–9.4 | 9.6 |
| Ash | 0.18 | 0.15 |
| $H_2O$ | 0.2 | 0.5 |
| Sediment | 0.2 mg. | 1.0 mg. |

EXAMPLE 11

The lactose from a sample of lactose slurry from a commercial crystallizer was filtered and washed at pH 10 and washed with water (1:1 ratio lactose to wash water) and dried in a warm oven. A similar control sample was prepared using two water washes with the same 1:1 ratio of lactose to wash water and no caustic wash.

TABLE IV

| | Product of Ex. 11 | Control |
|---|---|---|
| Color (Hunter Color and Color Difference Meter Number) | 0.1 | 5.6 |
| Ash % | 0.05 | 0.03 |
| Moisture % | 0.00 | 0.12 |
| pH of solution of product | 7.3 | 7.1 |

As can be seen from the results of this example, a significant reduction in color is obtained using the caustic wash technique as compared to an equivalent number of water washes.

EXAMPLES 12–33

Lactose was washed by slurrying lactose crystals in cold water followed by adding caustic to adjust pH. The alkaline lactose solution was pumped into a decanter to separate the crystals from the solution. Water was then injected into the decanter to wash the lactose crystals. The lactose crystals were than reslurried in a tank of cold water. The liquid was separated from the crystals and the crystals were dried in a fluid bed dryer. Cycles 12–19 were conducted on one day. Cycles 20–33 were conducted on the following day. Various materials were sampled and analyzed during the run. The results are reported in Table V which follows.

TABLE V

| | | Caustic Wash | | | | | Second Water Wash | | |
|---|---|---|---|---|---|---|---|---|---|
| | | | Sample Analysis | | | pH in | | | |
| Example | Time | Caustic Wash pH | Color Difference | Ash % | Solution pH of Product | Water Wash Tank | Color Difference | Ash % | Solution pH of Product |
| 12 (Control) | 3:15 | 6.87 | 5.6 | 0.17 | 6.99 | 7.44 | 2.7 | 0.03 | 7.24 |
| 13 | 3:40 | 9.98 | — | — | — | — | — | — | — |
| 14 | 3:53 | 10.33 | — | — | — | 9.75 | — | — | — |
| 15 | 4:08 | 10.37 | — | — | — | 9.82 | — | — | — |
| 16 | 4:20 | 10.12 | — | — | — | 9.30 | — | — | — |
| 17 | 5:00 | 10.00 | 2.8 | 0.02 | 7.05 | 9.34 | 0.8 | 0.03 | 7.00 |
| 18 | 6:00 | 9.95 | 1.8 | 0.09 | 7.74 | 9.29 | 0.1 | 0.05 | 7.76 |
| 19 | 7:00 | 10.00 | 0.0 | 0.05 | 7.22 | 9.34 | 1.5 | 0.08 | 6.78 |
| 20 (control) | 1:00 | 6.94 | 7.6 | 0.05 | 6.84 | 7.54 | 6.0 | 0.09 | 6.97 |
| 21 | 1:14 | 8.48 | — | — | — | — | — | — | — |
| 22 | 1:28 | 8.9 | — | — | — | 8.86 | — | — | — |
| 23 | 1:45 | 9.40 | — | — | — | 9.10 | — | — | — |
| 24 | 2:00 | 9.74 | — | — | — | 9.26 | — | — | — |
| 25 | 2:14 | 10.12 | — | — | — | 9.51 | — | — | — |
| 26 | 2:40 | 10.16 | — | — | — | 9.53 | — | — | — |
| 27 | 3:10 | 9.86 | 5.3 | 0.14 | 8.29 | 9.26 | 4.5 | 0.10 | 8.20 |
| 28 | 3:20 | 10.09 | — | — | — | 9.36 | — | — | — |
| 29 | 3:38 | 10.15 | — | — | — | 9.51 | — | — | — |
| 30 | 4:10 | 9.77 | 5.8 | 0.25 | 8.44 | 9.10 | 3.7 | 0.11 | 8.46 |
| 31 | 4:20 | 9.75 | — | — | — | 9.13 | — | — | — |
| 32 | 4:55 | 9.89 | — | — | — | 9.23 | — | — | — |
| 33 | 5:10 | 10.14 | 5.4 | 0.12 | 8.31 | 9.50 | 0.13 | 0.13 | 8.34 |

As can be seen from the results of this run, significant color reductions can be achieved using the process of the present invention.

The product of Example 12 (control) and the product of Example 19 after caustic washing but before the second water wash were analyzed for lactulose. The lactulose was detectable in an amount of less than 0.05% for the product of Example 12 (control, no caustic wash) and undetectable in the product of Example 19 (caustic wash, pH 10.3). The precision of this method is ± 2.9% at a 95% confidence level.

What is claimed is:

1. A process for purifying lactose which comprises washing lactose crystals in an alkaline wash bath having a pH within the range of from about 8.5 to about 12.5 at a temperature sufficient to prevent undesirable dissolution of said lactose crystals and isolating the so-washed lactose crystals from the bath.

2. The process as recited in claim 1 wherein the pH of the alkaline wash bath ranges from about 9 to about 12.0.

3. The process as recited in claim 1 wherein the pH of the alkaline wash bath ranges from about pH 9.5 to about pH 11.5.

4. The process as recited in claim 1 wherein the alkalizing agent for said alkaline bath is selected from the group consisting of alkali metal and alkaline earth metal hydroxides, oxides and carbonates.

5. The process as recited in claim 4 wherein said alkalizing agent is selected from the group consisting of oxides, hydroxides, and carbonates of sodium, potassium and calcium.

6. The process as recited in claim 1 wherein the alkaline wash bath temperature is within the range of from about 35° F. to about 80° F.

7. The process as recited in claim 6 wherein said alkaline wash bath temperature is within the range of from about 38° F. to about 60° F.

8. The process as recited in claim 1 wherein the concentration of lactose crystals in said alkaline wash bath ranges from about 5% to about 60% by weight on a dry solids basis.

9. The process as recited in claim 1 wherein the said isolated lactose crystals are water washed, isolated and dried.

10. The process as recited in claim 1 wherein said isolated lactose crystals are dried.

* * * * *